US008808873B2

(12) United States Patent
Chen et al.

(10) Patent No.: US 8,808,873 B2
(45) Date of Patent: Aug. 19, 2014

(54) CARRIER-ATTACHED COPPER FOIL AND METHOD FOR MANUFACTURING THE SAME

(75) Inventors: Yu-Chung Chen, Jhudong Township, Hsinchu County (TW); Yi-Ling Lo, Hsinchu (TW); Hung-Kun Lee, Sinjhuang (TW); Tzu-Ping Cheng, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 127 days.

(21) Appl. No.: 13/277,610

(22) Filed: Oct. 20, 2011

(65) Prior Publication Data

US 2012/0097544 A1 Apr. 26, 2012

(30) Foreign Application Priority Data

Oct. 21, 2010 (TW) ..... 99135902 A
Jan. 18, 2011 (TW) ..... 100101726 A

(51) Int. Cl.
*B32B 15/01* (2006.01)

(52) U.S. Cl.
USPC ..... 428/682; 428/618; 428/621; 428/629; 428/674; 428/676

(58) Field of Classification Search
CPC .... C23C 4/105; C23C 28/322; C23C 28/345; C23C 18/1241; C23C 28/30; C23C 28/32; B32B 15/01; B32B 15/20; B32B 2255/205; B23K 35/3033; B23K 35/302
USPC ..... 428/661, 668, 675, 678, 618, 621, 629, 428/674, 676, 682
See application file for complete search history.

(56) References Cited

U.S. PATENT DOCUMENTS

| | | | | |
|---|---|---|---|---|
| 3,998,601 | A | 12/1976 | Yates et al. | |
| 4,661,417 | A * | 4/1987 | Suzuki et al. | 428/607 |
| 5,066,366 | A | 11/1991 | Lin | |
| 5,114,543 | A | 5/1992 | Kajiwara et al. | |
| 5,262,247 | A | 11/1993 | Kajiwara et al. | |
| 6,346,335 | B1 | 2/2002 | Chen et al. | |
| 6,447,929 | B1 | 9/2002 | Wang et al. | |
| 6,569,543 | B2 | 5/2003 | Brenneman et al. | |
| 6,596,391 | B2 | 7/2003 | Smith | |
| 6,689,268 | B2 | 2/2004 | Chen et al. | |
| 6,702,916 | B2 | 3/2004 | Smith | |
| 6,770,976 | B2 | 8/2004 | Wang et al. | |
| 6,777,108 | B1 | 8/2004 | Obata et al. | |
| 6,924,043 | B2 | 8/2005 | Suzuki et al. | |
| 6,984,453 | B2 | 1/2006 | Sugimoto et al. | |
| 7,049,007 | B2 * | 5/2006 | Gales et al. | 428/607 |
| 7,223,481 | B2 | 5/2007 | Suzuki et al. | |
| 7,691,487 | B2 | 4/2010 | Nagatani | |
| 7,771,841 | B2 * | 8/2010 | Suzuki et al. | 428/675 |
| 2003/0153169 | A1 | 8/2003 | Wang et al. | |
| 2005/0048306 | A1 | 3/2005 | Suzuki et al. | |
| 2009/0291319 | A1 * | 11/2009 | Nagatani et al. | 428/607 |

FOREIGN PATENT DOCUMENTS

| | | | |
|---|---|---|---|
| CN | 1599513 | A | 3/2005 |
| CN | 101209604 | A | 7/2008 |
| EP | 1876266 | A1 | 1/2008 |
| JP | 06235050 | A | 8/1994 |
| JP | 2000-269637 | | 9/2000 |
| JP | 2000-309898 | | 11/2000 |
| JP | 2000-331537 | | 11/2000 |
| JP | 2000-340911 | | 12/2000 |
| JP | 2001-062955 | | 3/2001 |
| JP | 2001-089892 | | 4/2001 |
| JP | 2001-140090 | | 5/2001 |
| JP | 2001-140091 | | 5/2001 |
| JP | 2002-026475 | | 1/2002 |
| JP | 2002-292788 | | 10/2002 |
| JP | 2003-094553 | | 4/2003 |
| JP | 2003-181970 | | 7/2003 |
| JP | 2003-328178 | | 11/2003 |
| JP | 2004-124214 | | 4/2004 |
| JP | 2004-131836 | | 4/2004 |
| JP | 2004-148575 | | 5/2004 |
| JP | 2004-169181 | | 6/2004 |
| JP | 2004-273531 | | 9/2004 |
| JP | 2004-292788 | | 10/2004 |
| JP | 2005-048277 | | 2/2005 |
| JP | 2005-076091 | | 3/2005 |
| JP | 2005-161840 | | 6/2005 |
| JP | 2005-254673 | | 9/2005 |
| JP | 2005-260058 | | 9/2005 |
| JP | 2005-307270 | | 11/2005 |
| JP | 2005-312265 | | 11/2005 |
| JP | 2006-207032 | | 8/2006 |

(Continued)

OTHER PUBLICATIONS

Yamamoto et al., "Allowable Copper Thickness for Fine Pitch Patterns Formed by a Substractive Method", Circuit World, (2000), pp. 6-12.

(Continued)

*Primary Examiner* — Cathy Lam
(74) *Attorney, Agent, or Firm* — Muncy, Geissler, Olds & Lowe, P.C.

(57) ABSTRACT

In an embodiment of the invention, a method for manufacturing a carrier-attached copper foil is provided. The method includes providing a carrier foil including stainless steel, titanium, aluminum, nickel or alloy thereof with a surface oxide layer, and forming a copper foil onto the carrier foil to prepare the carrier-attached copper foil.

12 Claims, No Drawings

(56) References Cited

FOREIGN PATENT DOCUMENTS

| | | |
|---|---|---|
| JP | 2007-007937 | 1/2007 |
| JP | 2007-021921 | 2/2007 |
| JP | 2007-186781 | 7/2007 |
| JP | 2007-186797 | 7/2007 |
| JP | 2007-307767 | 11/2007 |
| JP | 2007-314855 | 12/2007 |
| JP | 2008-255462 | 10/2008 |
| JP | 2009-004423 | 1/2009 |
| JP | 2009-090570 | 4/2009 |
| JP | 2009-214308 | 9/2009 |
| JP | 2009-246120 | 10/2009 |
| TW | 442395 | 6/2001 |
| TW | 575668 | 2/2004 |
| TW | 200407060 | 5/2004 |
| TW | 2004-20208 | 10/2004 |
| TW | 2005-26819 | 8/2005 |
| TW | 2005-33261 | 10/2005 |
| TW | 2006-34182 | 10/2006 |
| TW | I276708 | 3/2007 |
| TW | 200713590 | 4/2007 |
| TW | 2008-03640 | 1/2008 |
| TW | 2008-06105 | 1/2008 |
| TW | 2009-38026 | 9/2009 |

OTHER PUBLICATIONS

Cheskis et al., "Ultra Thin Copper Foil for HDI Applications", Circuit Tree, (Nov. 1, 2004), pp. 1-17.

Abreu et al., "The Effect of Ni in the Electrochemical Properties of Oxide Layers Grown on Stainless Steels", Electrochimica Acta (2006), pp. 2991-3000, V51.

Sakairi, et al., "Effect of Potential, Temperature, and Flouride Ions on the Repassivation Kinectics of Titanium in Phosphate Buffered Saline Solution with the Photon Rupture Method" Laser Chemistry, (2009), pp. 1-8.

Okamoto, "Passive Film of 18-8 Stainless Steel Structure and its Function", Corrosion Science, (1973), pp. 471-489, vol. 13.

Abdel-Gaber, et al., "Kinectics and Thermodynamics of Aluminium Dissolution in 1.0 M Sulphuric Acid Containing Chloride Ions", Materials Chemistry and Physics, (2006), pp. 291-297, 98.

TW Office Action dated Jul. 8, 2013.

* cited by examiner

CARRIER-ATTACHED COPPER FOIL AND METHOD FOR MANUFACTURING THE SAME

CROSS REFERENCE TO RELATED APPLICATIONS

This Application claims priority of Taiwan Patent Application No. 99135902, filed on Oct. 21, 2010, and Taiwan Patent Application No. 100101726, filed on Jan. 18, 2011, the entireties of which are incorporated by reference herein.

BACKGROUND

1. Field

The disclosure relates to a carrier-attached copper foil, and more particularly to a copper foil attached with a carrier foil without a releasing layer and a method for manufacturing the same.

2. Description of the Related Art

With the development of light weight, thin profile, portable and high-functional electronic products, a high operation ability of HDI (High density interconnection) has become a necessary and increasingly important manufacturing process technology for the electronics industry. Among circuit boards, IC substrates and COF (Chip on Flex) have the strictest requirements for fine-patterned circuit. Traditionally, the circuit fabricating in the electronic industry mainly adopts a subtractive fabricating method which means surplus copper foil on a copper clad laminate is removed by etching process to form the required circuit patterns. In order to facilitate development of fine-patterned circuit and get rid of the adverse side-etching effect (etching factor) occurred in the wet etching process, the copper foil thickness utilized in the subtractive fabricating method has been continuously decreased for several years from 35 μm, through 18 μm, 12 μm, to current 8 μm—near the handability limit of free-standing copper foil. Therefore, not only the difficulty of fabrication increases dramatically, the development of fine-patterned circuit is also significantly limited.

Nowadays, the LCD industry adopts imported sputtering-processed FCCL products with copper thickness of 8 μm as COF raw materials. On the other hand, even having the same copper thickness of 8 μm, the FCCL products fabricated by the casting process dominant in FCCL industry, due to grain-coarsening of copper foil caused by a high-temperature casting process, are limited to applications with line width/line space (L/S)≥30/30 μm which does not meet needs of the current LCD industry. However, due to the high prices and poor performances (for example excessive pinholes, low and annealing sensitive peeling strength), the imported sputtering-processed FCCL products not only adversely affects the cost competitiveness in the short run, but also significantly affects the future development of the LCD industry in the long run for the incompleteness of the supply chain. Therefore, it needs to be exigently improved. In addition to the sputtering process, two other fine-patterned circuit fabricating methods including the so-called thick copper microetching thinning method and ultra thin copper foil (copper foil attached with carrier foil) method, are also considered but excluded by LCD industry for difficulty in control of copper foil thicknesses and a problem that the carrier foil cannot be peeled off (detach) after a high-temperature (≥300° C.) pressing operation respectively.

In conclusion, in considering the completeness of the LCD supply chain and the future development of the FCCL industry, it is necessary and exigent to enhance the existing casting process dominant in FCCL industry to meet COF application requirement.

BRIEF SUMMARY

One embodiment provides a carrier-attached copper foil having a two-layered structure, comprising: a carrier foil comprising stainless steel, titanium, aluminum, nickel or alloy thereof with a surface oxide layer; and a copper foil formed onto the carrier foil, wherein the copper foil is detachable from the carrier foil after the carrier-attached copper foil is processed with a high-temperature operation. In an embodiment, the high-temperature operation is performed at about 400° C. for one to two hours.

In an embodiment, the carrier foil comprises nickel alloyed 200 or 300 series austenitic stainless steel. The carrier foil has a ten-point mean roughness (Rz) of less than or equal to about 1.0 μm. The carrier foil has a center line mean roughness (Ra) of less than or equal to about 0.35 μm.

In an embodiment, the surface oxide layer is formed by spontaneous oxidization of the carrier foil under atmosphere. The surface oxide layer has a thickness of less than or equal to about 100 nm.

The copper foil has a thickness of about 0.01-12 μm.

One embodiment provides a method for manufacturing a copper foil with a carrier foil, comprising: providing a carrier foil comprising stainless steel, titanium, aluminum, nickel or alloy thereof with a surface oxide layer; and forming a copper foil onto the carrier foil to manufacture the carrier-attached copper foil, wherein the copper foil is detachable from the carrier foil after the carrier-attached copper foil is processed with a high-temperature operation.

The surface oxide layer is formed by spontaneous oxidation of the carrier foil under atmosphere. The copper foil is electroplated onto the carrier foil. The copper foil is electroplated using an electroplating solution. The electroplating solution comprises a complexing agent capable of forming a complex with copper ion. The complexing agent comprises pyrophosphate, citrate or ethylenediaminetetraacetic acid (EDTA).

The copper foil is still easily torn from the carrier foil (with a peeling strength of less than about 150 g/cm therebetween) after the carrier-attached copper foil is processed with the high-temperature operation which is performed at 360-400° C. for one to two hours.

In the invention, with a proper surface condition (for example roughness (Rz≤1.0 μm, Ra≤0.2 μm) and oxide layer thickness (≤100 nm)), and a proper copper foil electroplating solution and a proper operation condition (for example adding a complexing agent capable of forming a complex with copper ion, such as pyrophosphate, citrate or ethylenediaminetetraacetic acid (EDTA)), copper is directly electroplated onto a metal material (e.g., a carrier foil, for example titanium, stainless steel, zirconium, chromium, aluminum, nickel or alloy thereof) with a conductive oxide layer formed by spontaneous oxidization of the metal material under atmosphere without a releasing layer to manufacture a carrier-attached copper foil having a two-layered structure (e.g., a copper foil layer and a carrier foil layer) with improved peelability (for example with a peeling strength of less than 150 g/cm) between the copper foil layer and the carrier foil layer after a high-temperature operation (for example PI-casting (≥360° C., one hour) or annealing (≥400° C., two hours)). After the peeled metal carrier foil is simply stood under atmosphere for respectively proper duration of time in accordance with various carrier foil materials, the surface oxide layer formed thereon is self-repaired to make the metal carrier foil reusable.

The carrier-attached copper foil disclosed in this invention, due to wide operating temperature tolerance and easily adjustable copper foil thickness thereof, is suitably applied to various printed circuit boards (PCBs) (for example rigid PCBs, flexible PCBs and IC substrates) which have the strictest fine-patterned circuits requirements.

A detailed description is given in the following embodiments.

DETAILED DESCRIPTION

One embodiment provides a carrier-attached copper foil having a two-layered structure comprising a carrier foil comprising stainless steel, titanium, aluminum, nickel or alloy thereof with a surface oxide layer and a copper foil formed onto the carrier foil. The copper foil is detachable from the carrier foil after the carrier-attached copper foil is processed with a high-temperature operation. In an embodiment, the high-temperature operation is performed at about 400° C. for one to two hours.

In an embodiment, the carrier foil may comprise nickel alloyed 200 or 300 series austenitic stainless steel. The carrier foil may have a ten-point mean roughness (Rz) of less than or equal to about 1.0 μm. The carrier foil may have a center line mean roughness (Ra) of less than or equal to about 0.35 μm. The carrier foil has a thickness of about 0.018-0.2 mm.

In an embodiment, the surface oxide layer is formed by spontaneous oxidization of the carrier foil under atmosphere. The surface oxide layer may have a thickness of less than or equal to about 100 nm.

The copper foil has a thickness of about 0.01-12 μm.

One embodiment provides a method for manufacturing a carrier-attached copper foil comprising providing a carrier foil comprising stainless steel, titanium, aluminum, nickel or alloy thereof with a surface oxide layer and forming a copper foil onto the carrier foil to manufacture the carrier-attached copper foil. The copper foil is detachable from the carrier foil after the carrier-attached copper foil is processed with a high-temperature operation.

The carrier foil with a ten-point mean roughness (Rz) of less than or equal to about 1.0 μm, a center line mean roughness (Ra) of less than or equal to about 0.35 μm and a thickness of about 0.018-0.2 mm is obtained by, for example, a rolling process.

The surface oxide layer is formed by spontaneous oxidation of the carrier foil occurred under atmosphere. The copper foil is formed onto the carrier foil by, for example, electroplating. The electroplating process may use an electroplating solution. The electroplating solution may comprise a complexing agent capable of forming a complex with copper ion, for example pyrophosphate, citrate or ethylenediaminetetraacetic acid (EDTA).

The copper foil is still easily detached from the carrier foil (for example, with a peeling strength of less than about 150 g/cm) after the carrier-attached copper foil is processed with the high-temperature operation which is performed at 360-400° C. for one to two hours.

In the invention, with a proper surface condition (for example roughness (Rz≤1.0 μm, Ra≤0.2 μm) and oxide layer thickness (≤100 nm)), and a proper copper foil electroplating solution and a proper operation condition (for example adding a complexing agent capable of forming a complex with copper ion, such as pyrophosphate, citrate or ethylenediaminetetraacetic acid (EDTA)), copper is directly electroplated onto a metal material (e.g., a carrier foil, for example titanium, stainless steel, zirconium, chromium, aluminum, nickel or alloy thereof) with a conductive oxide layer formed by spontaneous oxidization of the metal material occurred under atmosphere without a release layer to manufacture a carrier-attached copper foil having a two-layered structure (e.g., a copper foil layer and a carrier foil layer) with improved peelability (for example with a peeling strength of less than about 150 g/cm) between the copper foil layer and the carrier foil layer after a high-temperature operation (for example PI-casting (≥360° C., one hour) or annealing (≥400° C., two hours)). After the peeled metal carrier foil is simply stood under the atmosphere for respective proper durations of time in accordance with various carrier foil materials, the surface oxide layer formed thereon is self-repaired to make the metal carrier foil reusable.

The carrier-attached copper foil disclosed in this invention is suitably applied to various printed circuit boards (PCBs) (for example rigid PCBs, flexible PCBs and IC substrates) which have strictest fine-patterned circuit requirements.

EXAMPLE 1

Physical Property Test for the Carrier-Attached Copper Foil

After a surface degreasing/cleaning process, three metal foils (titanium, stainless steel 304 and aluminum) capable of forming spontaneously surface oxide layer were placed in a copper pyrophosphate alkaline electroplating solution (condition: copper pyrophosphate: 40 g/L, potassium pyrophosphate: 290 g/L, sodium dodecyl sulfonate: 0.05 g/L, 45° C., Dk-1Amp/dm$^2$) to build a 1 μm-thick copper foil thereon. Copper was then electroplated on the three metal foils in a copper sulfate acidic electroplating solution (condition: sulfuric acid: 80 g/L, copper ion ($Cu^{2+}$): 40 g/L, chloride ion: 36 ppm, 50° C., Dk-4Amp/dm$^2$) to form a 7 μm-thick copper foil thereon. The total thickness of the formed copper foil was 8 μm. The results of the physical property test for the carrier-attached copper foil without a releasing layer are shown in Table 1.

TABLE 1

| Carrier materials | Titanium | Stainless steel 304 | Aluminum |
|---|---|---|---|
| Copper foil film-forming quality | Good | Good | Acceptable |
| Peeling at room temperature | Peelable | Peelable | Peelable |
| Peeling after annealing (400° C., two hours)*1 | Peelable (17-50 gf/cm) | Peelable (10-40 gf/cm) | Peelable (75.5 gf/cm) |
| Peeling after PI-casting (365° C., one hour)*2 | —*3 | Peelable (25-40 gf/cm) | — |
| Reusable at room temperature | Yes | Yes | — |
| Reusable after copper clad laminating (CCL) process | — | Yes | — |
| Reusable after PI-casting process | — | Yes | — |

*1 under hydrogen gas with the temperature history (heating from room temperature to 400° C. in 38 minutes, keep 400° C. fixed for two hours, and then natural cooling to room temperature)
*2 PI with a thickness of 25 μm
*3 no test Table 1 results indicated that the disclosed carrier-attached copper foil without a conventional releasing layer possessed ideal peelability (e.g., with a low peeling strength of 10-40 g/cm) and high temperature (400° C. for two hours above) operating capability for the flexible copper clad laminate (FCCL) industry, not only make the casting process applicable to chip-on-film (COF) products, but also applicable to semi-additive-process (SAP) products, can simultaneously effectively improve the completeness of the supply chain of the LCD industry and industrial competitiveness of the FCCL industry. Additionally, the peeled carrier foil is reusable which solves the cost problem of conventional expensive carrier-attached copper foil.

EXAMPLE 2

The Influence of Surface Roughness of the Stainless Steel 304 Carrier Foil on Peeling Strength Four specimens of the stainless steel 304 with various surface roughness were placed in a copper pyrophosphate alkaline electroplating solution (condition: copper pyrophosphate: 40 g/L, potassium pyrophosphate: 290 g/L, sodium dodecyl sulfonate: 0.05 g/L, 45° C.) to build a 1 μm-thick copper foil thereon. Copper was then electroplated on the four specimens of the stainless steel 304 in a copper sulfate acidic electroplating solution (condition: sulfuric acid: 80 g/L, copper ion ($Cu^{2+}$): 40 g/L, chloride ion: 36 ppm, ambient temperature) to form another 7 μm-thick copper foil thereon. The total thickness of the formed copper foil was 8 μm. The carrier-attached copper foil without a releasing layer was then annealed under hydrogen gas environment at 400° C. for two hours. The peeling test results of the carrier-attached copper foil are shown in Table 2.

TABLE 2

| | | Specimen No. | | | |
|---|---|---|---|---|---|
| | | 990422-3 | 990423-6 | 990423-7 | 990423-8 |
| Copper pyrophosphate | Dk | 1.2 | 1.2 | 1.2 | 1.2 |
| Copper sulfate/ Sulfuric acid | Dk | 4 | 4 | 4 | 4 |
| Thickness | μm | 1 + 7 | 1 + 7 | 1 + 7 | 1 + 7 |
| Rz | μm | 0.609 | 0.452 | 0.450 | 0.704 |
| Ra | μm | 0.125 | 0.076 | 0.076 | 0.096 |
| Peeling strength | gf/cm | 40.0 | 8.1 | 12.1 | 136.4 |
| High temperature operation conditions | | 400° C., two hours | 400° C., two hours | 400° C., two hours | 400° C., two hours |

While the disclosure has been described by way of example and in terms of preferred embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A carrier-attached copper foil, comprising:

a carrier foil comprising nickel alloyed 200 or 300 series austenitic stainless steel with a surface oxide layer; and a copper foil directly electroplated onto the carrier foil, wherein the copper foil is detachable from the carrier foil after the carrier-attached copper foil is processed with a high-temperature operation.

2. The carrier-attached copper foil as claimed in claim 1, wherein the high-temperature operation is performed at about 400° C. for one to two hours.

3. The carrier-attached copper foil as claimed in claim 1, wherein the surface oxide layer is formed by spontaneous oxidization of the carrier foil under atmosphere.

4. The carrier-attached copper foil as claimed in claim 1, wherein the carrier foil has a ten-point mean roughness (Rz) of less than or equal to about 1.0 μm.

5. The carrier-attached copper foil as claimed in claim 1, wherein the carrier foil has a center line mean roughness (Ra) of less than or equal to about 0.35 μm.

6. The carrier-attached copper foil as claimed in claim 1, wherein the surface oxide layer has a thickness of less than or equal to about 100 nm.

7. The carrier-attached copper foil as claimed in claim 1, wherein the copper foil has a thickness of about 0.01-12 μm.

8. A method for manufacturing a carrier-attached copper foil, comprising:

providing a carrier foil comprising nickel alloyed 200 or 300 series austenitic stainless steel with a surface oxide layer, wherein the surface oxide layer is formed by spontaneous oxidation of the carrier foil under atmosphere; and electroplating a copper foil directly onto the surface oxide layer of the carrier foil to manufacture the carrier-attached copper foil, wherein the copper foil is detachable from the carrier foil after the carrier-attached copper foil is processed with a high-temperature operation.

9. The method for manufacturing a carrier-attached copper foil as claimed in claim 8, wherein the copper foil is electroplated using an electroplating solution.

10. The method for manufacturing a carrier-attached copper foil as claimed in claim 9, wherein the electroplating solution comprises a complexing agent capable of forming a complex with copper ion.

11. The method for manufacturing a carrier-attached copper foil as claimed in claim 10, wherein the complexing agent comprises pyrophosphate, citrate or ethylenediaminetetraacetic acid (EDTA).

12. The method for manufacturing a carrier-attached copper foil as claimed in claim 8, wherein the copper foil and the carrier foil have a peeling strength of less than about 150 g/cm after the carrier-attached copper foil is processed with the high-temperature operation which is performed at about 400° C. for one to two hours.

* * * * *